US006487782B1

(12) United States Patent
Bond

(10) Patent No.: US 6,487,782 B1
(45) Date of Patent: Dec. 3, 2002

(54) METHOD AND APPARATUS FOR USE IN CREATING A MAGNETIC DECLINATION PROFILE FOR A BOREHOLE

(75) Inventor: Bruce John Bond, Alberta (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/708,061

(22) Filed: Nov. 8, 2000

(30) Foreign Application Priority Data

Dec. 3, 1999 (CA) ..... 2291545

(51) Int. Cl.[7] ..... E21B 47/022
(52) U.S. Cl. ..... 33/302; 33/304; 33/313
(58) Field of Search ..... 83/302, 303, 304, 83/312, 313

(56) References Cited

U.S. PATENT DOCUMENTS

| | | | | |
|---|---|---|---|---|
| 3,704,749 A | | 12/1972 | Estes et al. | |
| 3,964,553 A | | 6/1976 | Basham et al. | |
| 4,410,051 A | | 10/1983 | Daniel et al. | |
| 4,433,491 A | | 2/1984 | Ott et al. | |
| 4,593,770 A | | 6/1986 | Hoehn, Jr. | |
| 4,682,421 A | | 7/1987 | Van Dongen et al. | |
| 5,103,177 A | | 4/1992 | Russell et al. | |
| 5,172,480 A | * | 12/1992 | Labuc et al. | 33/304 |
| 5,435,069 A | | 7/1995 | Nicholson | |
| 5,582,248 A | | 12/1996 | Estes | |
| 5,606,124 A | * | 2/1997 | Doyle et al. | 33/304 |
| 5,787,997 A | | 8/1998 | Hartmann | |
| 5,806,194 A | | 9/1998 | Rodney et al. | |
| 6,021,577 A | * | 2/2000 | Shiells et al. | 33/304 |
| 6,076,268 A | | 6/2000 | Fuhr | |
| 6,179,067 B1 | * | 1/2001 | Brooks | 33/304 |
| 6,227,310 B1 | * | 5/2001 | Jamieson | 33/303 |
| 6,321,456 B1 | * | 11/2001 | McElhinney | 33/313 |

FOREIGN PATENT DOCUMENTS

CA 2255474 6/1999

OTHER PUBLICATIONS

Sperry–Sun Drilling Services of Canada Brochure entitled "Borehole Surveying", undated, pp. 1–20.
Sperry–Sun Drilling Services Brochure entitled "G2 High Accuracy Gyro Service", undated, 2 pages.
Sperry–Sun Drilling Services Brochure entitled "ESS—Electronic Survey Service High Accuracy Magnetic Surveying", undated, 4 pages.
Sperry–Sun Drilling Services Brochure entitled "ESS—Electronic Core Orientation Service", undated, 2 pages.

* cited by examiner

*Primary Examiner*—Diego Gutierrez
*Assistant Examiner*—Travis Reis
(74) *Attorney, Agent, or Firm*—Terrence N. Kuharchuk; William Shull; Michael D. McCully

(57) ABSTRACT

A method and apparatus for use in creating a magnetic declination profile for a borehole. The method includes the steps of making a magnetic directional measurement at a longitudinal location in the borehole and at a magnetic measurement orientation, making a reference directional measurement at a reference measurement orientation, wherein there is a known orientation relationship between the magnetic measurement orientation and the reference measurement orientation, and obtaining a value of magnetic declination at the longitudinal location in the borehole using the magnetic directional measurement, the reference directional measurement and the orientation relationship. The apparatus includes a magnetic instrument for making a magnetic directional measurement, a magnetic orientation calibration indicator associated with the magnetic instrument for providing a magnetic instrument calibration orientation, a reference instrument linked with the magnetic instrument for making a reference directional measurement and a reference orientation calibration indicator associated with the reference instrument for providing a reference instrument calibration orientation.

17 Claims, 1 Drawing Sheet

METHOD AND APPARATUS FOR USE IN CREATING A MAGNETIC DECLINATION PROFILE FOR A BOREHOLE

TECHNICAL FIELD

A method and apparatus for use in creating a magnetic declination profile for a borehole, which magnetic declination profile can be used to correct directional measurements made in the borehole with magnetic instruments.

BACKGROUND OF THE INVENTION

Measuring devices and methods used in boreholes typically make use of one or more earth fields in order to provide measurements for the inclination and direction of a borehole and for the orientation of objects located in the borehole.

The inclination of a borehole is sometimes referred to as the "drift" of the borehole and is an expression of the deviation of the borehole from vertical (i.e., from the direction of the earth's gravity vector).

The direction of a borehole is sometimes referred to as the "azimuth" of the borehole and is an expression of the direction of the borehole in a horizontal plane relative to a calibration direction such as magnetic North or true North.

The orientation of a point or object in a borehole is sometimes referred to as the "toolface" of the point or object and is an expression of the orientation of the point or object in a plane perpendicular to the longitudinal axis of the borehole relative to a reference orientation.

A variety of measuring instruments have evolved for the measurement of inclination and direction of a borehole and the orientation of points or objects in the borehole.

Inclination measurements in a borehole are commonly made with instruments that are sensitive to the earth's gravity field. Such gravity instruments include, for example, plumb bobs and accelerometers and are typically capable of measuring the amount of vertical deviation of the borehole but not the direction of the vertical deviation.

Directional measurements in a borehole are commonly made with instruments which are sensitive to the earth's magnetic field. Such magnetic instruments include, for example, compasses and magnetometers. Magnetic instruments are typically capable of providing a measurement of the direction of the borehole in a borehole coordinate system, but are unable to convert this measurement to a direction or azimuth of the borehole in a more useful reference coordinate system which is defined by the direction of the gravity vector and by compass directions in a plane perpendicular to the gravity vector.

The reference coordinate system conventionally has its X-axis parallel to the earth's surface and pointing North, its Y-axis parallel to the earth's surface and pointing East, and its Z-axis perpendicular to the earth's surface and pointing vertically down.

The borehole coordinate system is conventionally described as having its z-axis along the borehole axis, its y-axis parallel to the earth's surface and its x-axis perpendicular to both the y and z axes.

As a result, measurements taken with instruments which are sensitive to the earth's magnetic field are typically converted to values corresponding with the reference coordinate system in order to provide enhanced survey accuracy. Conventionally, this conversion is carried out by using data relating to the inclination of the borehole to transform data relating to the direction of the borehole in the borehole coordinate system to values expressed in the reference coordinate system.

Measurements of the orientation of a point or object in a borehole may be made with gravity instruments. For example, the "high side" or the "low side" of a borehole can be determined with instruments which are sensitive to the earth's gravity field.

Measurements of the orientation of a point or object in a borehole may also be made with magnetic instruments. Such measurements are sometimes referred to as "magnetic toolface" measurements and are essentially an expression of the orientation of the point or object relative to the x and y axes in the borehole coordinate system.

As a result of the above, borehole survey apparatus often include gravity instruments which are sensitive to the earth's gravity field as well as magnetic instruments which are sensitive to the earth's magnetic field so that the apparatus are capable of providing measurements of the inclination and direction of the borehole as well as the orientation of points or objects in the borehole.

Survey apparatus of the type described above are typically quite rugged and capable of enduring severe environmental conditions of vibration, heat and pressure. They are thus well suited to the rigors of use in downhole equipment such as drilling assemblies and measurement while drilling (MWD) systems.

Unfortunately, however, there are difficulties associated with the use of survey apparatus which include magnetic instruments. First, magnetic instruments take directional measurements relative to magnetic North instead of true North, with the result that magnetic directional measurements must be corrected so that they are expressed relative to true North. Such correction is typically performed empirically with the use of magnetic declination charts, thus complicating and contributing a source of error to the resulting corrected measurement.

Second, survey apparatus including magnetic instruments are also not well suited for use in circumstances where interference with the earth's magnetic field is present. For example, magnetic instruments are not commonly used for borehole surveys in boreholes which are lined with metal casing.

Furthermore, when magnetic instruments are used in drilling assemblies or MWD systems, they are typically isolated from the interfering magnetic effects of the drilling string by being contained in non-magnetic housings and by being located adjacent to non-magnetic drill collars or drill pipe. Despite such measures, error remains present in magnetic instrument measurements due to the influence of magnetic deposits (or the casing of nearby boreholes) in the formation being drilled and due to the effects of magnetism in the drilling string and the drilling assembly.

The effects of magnetism in the drilling string and the drilling assembly are reasonably well understood and numerous methods have been developed for addressing the measurement error resulting from these effects. Examples of such methods are found in U.S. Pat. No. 4,682,421 (van Dongen et al), U.S. Pat. No. 5,103,177 (Russell et al), U.S. Pat. No. 5,435,069 (Nicholson), U.S. Pat. No. 5,787,997 (Hartmann) and U.S. Pat. No. 5,806,194 (Rodney et al).

Some efforts have also been made to address the issues associated with orienting objects in a borehole using magnetic instruments where magnetic deposits or adjacent casing strings are present. Typically these methods are used to avoid adjacent boreholes during perforation operations or during drilling of a borehole and may in fact utilize the interfering effects caused. by such adjacent boreholes. Examples of such methods are found in U.S. Pat. No. 3,704,749 (Estes et al), U.S. Pat. No. 3,964,553 (Basham et al), U.S. Pat. No. 4,593,770 (Hoehn) and U.S. Pat. No. 5,582,248 (Estes).

Many of the difficulties associated with the use of magnetic instruments to take measurements in boreholes may be overcome by using instruments which take measurements which are not influenced by magnetic flux in the borehole. These instruments typically measure changes of direction relative to a calibration direction. One example of such an instrument is a conventional gyroscope, which can be oriented in a calibration direction and will then sense movement relative to the calibration direction.

Such "non-magnetic" instruments may also utilize an earth field vector to assist in establishing the calibration direction, such as the earth's inertial angular velocity vector as described in U.S. Pat. No. 4,433,491 (Ott et al). One example of a "non-magnetic" instrument which makes use of the earth's inertial angular velocity vector is a "north seeking" gyroscopic instrument, which is capable of taking directional measurements relative to true North.

Gyroscopic instruments of a variety of types are used frequently to survey existing boreholes and are particularly suited for use in boreholes containing casing, since gyroscopic instruments are not influenced by magnetic flux and in particular by magnetic interference caused by metallic casing. Gyroscopic instruments are also capable of taking relatively accurate and reliable measurements.

Unfortunately, however, gyroscopic instruments are not particularly rugged and are thus not well suited for use in drilling assemblies or in MWD systems. As a result, the use of gyroscopic instruments for taking measurements in boreholes is generally confined to lowering the gyroscopic instrument in the borehole on a wireline to take measurements before a downhole operation in the borehole has taken place or after such an operation has been completed. The actual downhole operation is performed either without measurements being taken or with the use of survey apparatus including magnetic instruments which inherently provide errors due to discrepancies between true North and magnetic North and magnetic effects of nearby magnetic deposits or adjacent casing strings.

There is therefore a need for a method and apparatus for creating a magnetic declination profile for a borehole which will assimilate errors which are inherent in measurements made by magnetic instruments, so that directional measurements made with magnetic instruments can easily be corrected to provide reliable directional information pertaining either to the direction of the borehole or the orientation of a point or object in the borehole.

SUMMARY OF THE INVENTION

The present invention is a method and apparatus for creating a magnetic declination profile for a borehole. The magnetic declination profile may include a value of magnetic declination at as few as one longitudinal location in the borehole. Preferably, however, the magnetic declination profile includes values of magnetic declination at more than one longitudinal location in the borehole.

The method involves making a magnetic directional measurement at a longitudinal location in the borehole, wherein the magnetic directional measurement is influenced by magnetic flux in the borehole. The magnetic directional measurement is made at a magnetic measurement orientation. The method further involves making a reference directional measurement, wherein the reference directional measurement is not influenced by magnetic flux in the borehole. The reference directional measurement is made at a reference measurement orientation, wherein there is an orientation relationship between the magnetic measurement orientation and the reference measurement orientation and wherein the orientation relationship is known or is ascertainable. A value of magnetic declination at the longitudinal location can then be obtained using the magnetic directional measurement, the reference directional measurement and the orientation relationship.

The magnetic directional measurement may be any directional measurement which is influenced by magnetic flux and which is directed at determining the direction of magnetic vectors. Preferably the magnetic directional measurement is directed at determining directions relative to the earth's magnetic field vector but includes the effects of interfering magnetic vectors which could influence the magnetic directional measurement.

The reference directional measurement may be any directional measurement which is not influenced by magnetic flux. Preferably the reference directional measurement is directed at determining changes of direction relative to a calibration direction, which calibration direction may be provided by an earth field vector such as the earth's inertial angular velocity vector or may be provided in some other manner.

The value of magnetic declination that is obtained using the invention may be a representation of the difference between true North and magnetic North at the longitudinal location if no sources of magnetic interference are present at the longitudinal location. Usually, however, the value of magnetic declination is a representation of any and all magnetic influences at the longitudinal location of the type which will result in the magnetic directional measurement being different from the reference directional measurement when the magnetic measurement orientation is the same as the reference measurement orientation.

In one method aspect of the invention, the invention is comprised of a method for creating a magnetic declination profile for a borehole comprising the steps of:

(a) making a first magnetic directional measurement at a first longitudinal location in the borehole, wherein the first magnetic directional measurement is influenced by magnetic flux and wherein the first magnetic directional measurement is made at a first magnetic measurement orientation;

(b) making a first reference directional measurement, wherein the first reference directional measurement is not influenced by magnetic flux, wherein the first reference directional measurement is made at a first reference measurement orientation, wherein there is a first orientation relationship between the first magnetic measurement orientation and the first reference measurement orientation and wherein the first orientation relationship is known or ascertainable; and (c) obtaining a value of magnetic declination at the first longitudinal location in the borehole using the first magnetic directional measurement, the first reference directional measurement and the first orientation relationship.

The first magnetic directional measurement may be made using any method or apparatus which is influenced by magnetic flux. Preferably the first magnetic directional measurement is made using a magnetic instrument. The magnetic instrument may be comprised of a compass. Preferably the magnetic instrument is comprised of a magnetometer. In the preferred embodiment the magnetometer is a triaxial magnetometer which is capable of measuring magnetic flux along three mutually perpendicular axes. The first magnetic directional measurement provides an indication of the direction of the resultant magnetic field vector at the first longitudinal location and may optionally also provide an indication of the magnitude of the resultant magnetic field at the first longitudinal location.

The first reference directional measurement may be made using any method or apparatus which is not influenced by magnetic flux. The first reference directional measurement may be made using a reference instrument which measures changes of direction relative to a calibration direction. The calibration direction may be related or unrelated to the earth's inertial angular velocity vector. Preferably the reference directional measurement is made with a reference instrument which is comprised of a gyroscopic instrument.

The step of obtaining the value of magnetic declination may be comprised of the steps of calculating a first measurement differential between the first magnetic directional measurement and the first reference directional measurement, calculating a first orientation differential between the first magnetic measurement orientation and the first reference measurement orientation, and adjusting the first measurement differential by the amount of the first orientation differential to obtain the value of magnetic declination at the first longitudinal location in the borehole.

The first orientation differential may be any amount or value but is preferably equal to zero so that the first measurement differential is equal to the value of magnetic declination at the first longitudinal location in the borehole. The first orientation differential may be established by linking the magnetic instrument and the reference instrument.

The invention may be used to create a magnetic declination profile in any borehole. The invention is, however, particularly well suited for use in boreholes having an inclination relative to vertical of less than about five degrees, since values of magnetic declination in such boreholes cannot conventionally be obtained effectively by combining magnetic directional measurements with data from previous borehole surveys indicating borehole inclination and azimuth. As a result, preferably the method is used to obtain a value of magnetic declination where the inclination of the borehole at the first longitudinal location is less than about five degrees.

In addition, although the invention may be used to create magnetic declination profiles in open or uncased boreholes, the invention is particularly suited for use in boreholes containing a metallic casing. The presence of metallic casing in the borehole will result in magnetic interference which can be assimilated into the magnetic declination profile. As a result, preferably the method is used to obtain a value of magnetic declination where the borehole is lined with a metallic casing at or in the proximity of the first longitudinal location.

The method may be used to create a magnetic declination profile for the borehole at only the first longitudinal location. Preferably, however, the method is performed at a plurality of longitudinal locations in the borehole in order to create a magnetic declination profile for the borehole at the plurality of longitudinal locations.

For example, the method may be performed at a second longitudinal location in the borehole by performing the following steps:

(d) making a second magnetic directional measurement at a second longitudinal location in the borehole, wherein the second magnetic directional measurement is influenced by magnetic flux and wherein the second magnetic directional measurement is made at a second magnetic measurement orientation;

(e) making a second reference directional measurement, wherein the second reference directional measurement is not influenced by magnetic flux, wherein the second reference directional measurement is made at a second reference measurement orientation, wherein there is a second orientation relationship between the second magnetic measurement orientation and the second reference measurement orientation and wherein the second orientation relationship is known; and (f) obtaining a value of magnetic declination at the second longitudinal location in the borehole using the second magnetic directional measurement, the second reference directional measurement and the second orientation relationship.

Similarly, the step of obtaining the value of magnetic declination at the second longitudinal location may be comprised of the following steps:

(d) calculating a second measurement differential between the second magnetic directional measurement and the second reference directional measurement;

(e) calculating a second orientation differential between the second magnetic measurement orientation and the second reference measurement orientation; and (f) adjusting the second measurement differential by the amount of the second orientation differential to obtain the value of magnetic declination at the second longitudinal location in the borehole.

The second orientation relationship may be different from the first orientation relationship, but preferably the second orientation relationship and the first orientation relationship are the same so that the second orientation differential is equal to the first orientation differential.

In an apparatus aspect of the invention, the invention is comprised of an apparatus for use in creating a magnetic declination profile for a borehole comprising:

(a) a magnetic instrument for making a magnetic directional measurement which is influenced by magnetic flux;

(b) a magnetic orientation calibration indicator associated with the magnetic instrument for providing a magnetic instrument calibration orientation;

(c) a reference instrument for making a reference directional measurement which is not influenced by magnetic flux; and (d) a reference orientation calibration indicator associated with the reference instrument for providing a reference instrument calibration orientation;

wherein the magnetic instrument and the reference instrument are linked such that a constant indicator differential can be maintained between the magnetic orientation calibration indicator and the reference orientation calibration indicator.

The reference instrument may be comprised of any apparatus or device which is capable of making a directional measurement which is not influenced by magnetic flux. Preferably the reference instrument is comprised of a gyroscopic instrument.

The magnetic instrument calibration orientation provided by the magnetic orientation calibration indicator may be referenced to any calibration direction, but is preferably referenced to some known direction relative to magnetic North. Most preferably, the magnetic orientation calibration indicator is configured so that the magnetic instrument indicates magnetic North when the magnetic orientation calibration indicator is pointed at magnetic North (in the absence of sources of magnetic interference).

The reference instrument calibration orientation provided by the reference orientation calibration indicator may be referenced to any calibration direction, but is preferably referenced to some known direction relative to true North. Most preferably, the reference orientation calibration indicator is configured so that the reference instrument indicates true North when the reference orientation calibration indicator is pointed at true North.

The magnetic orientation calibration indicator may be aligned with the reference orientation calibration indicator to provide any amount of indicator differential. Preferably, however, the magnetic orientation calibration indicator is aligned with the reference orientation calibration indicator such that the indicator differential is equal to zero.

The magnetic instrument and the reference instrument are each preferably contained in a housing, which housing adjacent to the magnetic instrument is preferably comprised substantially of a non-magnetic material so that the housing does not provide a source of magnetic interference. The housing may be comprised of a single housing section or may be comprised of a plurality of housing sections.

The apparatus may be lowered into the borehole in any manner, and may be incorporated into a pipe string. Preferably, however, the apparatus is lowered into the borehole on a wireline. The apparatus is preferably further comprised of a connector for connecting the apparatus to the wireline or to a pipe string.

Preferably the distance between the reference instrument and the magnetic instrument is minimized in order to reduce the likelihood of error due to misalignment of the instruments or due to bending or other deformation of the apparatus during use.

In the preferred embodiment, however, the reference instrument is separated longitudinally from the magnetic instrument to minimize the likelihood of either instrument interfering with the measurements of the other instrument. In the preferred embodiment, the amount of longitudinal separation between the instruments is preferably a convenient distance such as one meter or a multiple of one meter so that the position of the reference instrument in the borehole can easily be calculated from the position of the longitudinal locations at which magnetic measurements are made, and vice versa.

This in turn assists in the creation of the magnetic declination profile, particularly where the magnetic instrument and the reference instrument collect other data which is not directly related to the creation of the magnetic declination profile, since such other data may be used to provide a survey of the borehole which in turn may possibly be used to verify the measurements of the magnetic instrument and the reference instrument.

In a further method aspect of the invention, the invention is comprised of a method for conducting a magnetic declination survey for a borehole, the method comprising the following steps:

(a) connecting a magnetic instrument with a gyroscopic instrument to provide a magnetic declination logging tool;

(b) aligning a magnetic orientation calibration indicator associated with the magnetic instrument with a reference orientation calibration indicator associated with the gyroscopic instrument to provide a known first indicator differential between the magnetic orientation calibration indicator and the reference orientation calibration indicator;

(c) lowering the magnetic declination logging tool into the borehole to position the magnetic instrument at a first longitudinal location;

(d) making a first magnetic directional measurement with the magnetic instrument at the first longitudinal location;

(e) making a first reference directional measurement with the gyroscopic instrument; and (f) obtaining a value of magnetic declination at the first longitudinal location in the borehole using the first magnetic directional measurement, the first reference directional measurement and the first indicator differential.

This further method aspect of the invention combines the features of the method and apparatus aspects of the invention described above.

BRIEF DESCRIPTION OF DRAWINGS

Embodiments of the invention will now be described with reference to the accompanying drawings, in which.

DETAILED DESCRIPTION

The invention relates to a method and apparatus for providing a measure of the amount of error which is inherent in a magnetic measurement taken in a borehole relative to a measurement which is not influenced by magnetic flux. The error may be caused by magnetic influences present in or adjacent to the borehole. The error may also be caused by the usual discrepancy between magnetic North and true North.

The measure of the amount of error may be used to create a magnetic declination profile for the borehole at one or more longitudinal locations in the borehole.

In the preferred embodiment, the invention includes both a method and an apparatus for performing the method. In the preferred embodiment, the method may be practiced in conjunction with a variety of borehole configurations.

Essentially, the invention is comprised of making both a magnetic directional measurement and a reference directional measurement under conditions in which the relationship is known between the orientation at which the magnetic directional measurement is made and the orientation at which the reference directional measurement is made.

The invention may be used in any borehole. The advantages of the invention are, however, most apparent when the invention is used in a borehole in which a significant amount of magnetic interference is present. Such a circumstance may exist where there is casing or other metallic objects present in the borehole or where the ground through which the borehole passes contains significant metal deposits. In the preferred embodiment, the invention is used in a borehole which is lined at least in part with a metallic casing.

Furthermore, the invention may be used in vertical boreholes or in non-vertical boreholes having any amount of inclination relative to vertical. The advantages of the invention are, however, most apparent when the invention is used in a borehole which is vertical or near vertical (i.e., with less than or equal to about five degrees inclination relative to vertical). Where the inclination of the borehole relative to vertical is significant, magnetic measurements can typically be correlated with separately gathered survey data and/or inclinometer measurements in order to provide a reasonably reliable magnetic measurement, thus reducing the need for the invention. In the preferred embodiment, the invention is used primarily in portions of a borehole which have an inclination less than or equal to about five degrees relative to vertical.

One of the primary applications of the invention is to provide a declination profile through a section of a borehole in which some downhole operation or operations are to be performed, which operations require a reliable directional measurement to be made.

Figure 1:
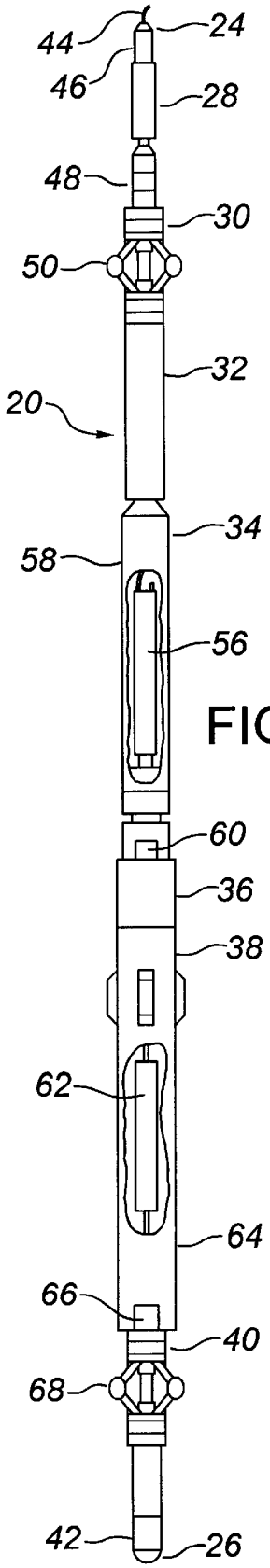
FIG. 1 is a schematic drawing depicting a preferred embodiment of a magnetic declination logging tool according to the invention.
Figure 2:
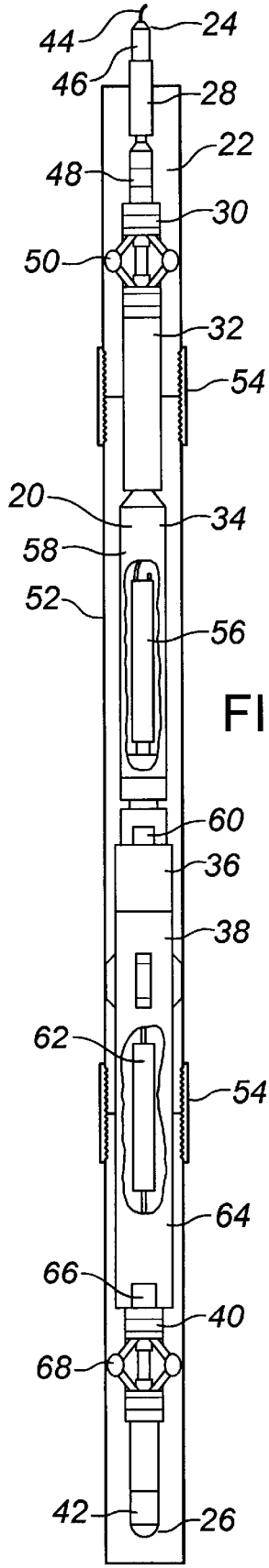
FIG. 2 is a schematic drawing depicting the magnetic declination logging tool of FIG. 1 inserted in a borehole lined with a casing string.

Referring to FIG. 1 and FIG. 2, in the preferred embodiment the apparatus of the invention is comprised of a magnetic declination logging tool (20) for insertion in a borehole (22).

From an upper end (24) to a lower end (26) of the tool (20), in the preferred embodiment the tool (20) includes a connector section (28), an upper centralizer section (30), a casing collar locator ("CCL") section (32), a reference probe section (34), a crossover section (36), a magnetic probe section (38), a lower centralizer section (40) and a bull nose section (42). The various sections of the tool (20) are in the preferred embodiment connected to each other end to end with threaded connections. The sections may, however, be connected together in a different order, in a different manner, and two or more sections may also be combined into one section. The guiding limitation in the configuration of the tool (20) is that the tool (20) must be capable of passing through the borehole (22).

The connector section (28) enables the tool (20) to be connected to a wireline (44), a pipe string (not shown) or some similar apparatus so that the tool (20) can be lowered into and retrieved from the borehole (22). The connector section (28) includes a cablehead (46) as a connector and a top plug (48). The wireline (44) is supported within and extends from the cablehead (46). Other types and configurations of connector may be used.

The upper centralizer section (30) assists in centralizing the tool (20) in the borehole (22). In the preferred embodiment the upper centralizer section (30) includes a plurality of upper bow springs (50) as centralizing devices which engage the borehole (22) as the tool (20) passes through the borehole (22). Any other type of centralizing device may be used in the upper centralizer section (30), or the upper centralizer section (30) may be eliminated altogether.

In the preferred embodiment at least a portion of the borehole is lined with a casing string (52) consisting of lengths of casing connected together with casing collars (54). The casing collar locator section (32) assists in establishing accurate depth control for the tool (20) by sensing the presence of the casing collars (54) in the casing string (52). The casing collar locator section (32) includes one or more magnetic sensors (not shown) which are capable of sensing a change in magnetic flux as the tool (20) passes a casing collar (54). The casing collar locator section (32) may include a source of magnetic field or it may rely on the earth's magnetic field. In the preferred embodiment, the casing collar locator section (32) is equipped with a source of magnetic field (not shown) which generates a magnetic field which is sensed by the magnetic sensors (not shown). The casing collar locator section (32) is optional and in fact will not be necessary if the borehole (22) is uncased or if the casing string (52) does not include casing collars (54).

The reference probe section (34) is used to provide a reference directional measurement which is not influenced by magnetic flux. As a result, the reference probe section (34) includes at least one reference instrument which may be comprised of any apparatus or device which can make such a reference directional measurement.

In the preferred embodiment the reference probe section (34) includes a reference instrument which is comprised of a gyroscopic instrument (56) contained within a reference probe housing (58). Any type of gyroscopic instrument (56) capable of making the reference directional measurement may be utilized in the reference probe section (34).

For example, the gyroscopic instrument (56) may include a standard gyroscopic instrument which requires orientation relative to a calibration direction by taking an external measurement or may include a north seeking gyroscopic instrument which uses true North as a calibration direction by utilizing the horizontal component of the earth's inertial angular velocity vector. In the preferred embodiment the reference probe section (34) includes as the reference instrument a north seeking gyroscopic instrument such as a G2™ gyroscope system manufactured by Sperry-Sun Drilling Services.

The G2™ gyroscope system includes a two-axis gyroscope and a triaxial accelerometer. The horizontal component of the earth's inertial angular velocity vector is determined by correlation of the output of the gyroscope with the output of the accelerometer, thus enabling the system to be aligned to true North without the need for an external measurement. The second axis of the G2™ gyroscope system allows reliable directional measurements to be made by the system even where the inclination of the borehole (22) approaches or exceeds about 70° relative to vertical and the first axis is thus unable to provide reliable directional data.

One limitation of a north seeking gyroscopic instrument is that it becomes less reliable as a gyrocompass at latitudes approaching or exceeding about 80°. As a result, where the tool (20) is used at such latitudes a north seeking gyroscopic instrument will function as a conventional gyroscopic instrument, requiring an external measurement in order to obtain a calibration direction.

The function of the reference probe section (34) is to provide a reference directional measurement which is not influenced by magnetic flux and to provide a mechanism to assist in establishing an orientation relationship between the reference probe section (34) and the magnetic probe section (38). As a result, the reference probe section (34) is equipped with an orientation calibration indicator for providing a calibration orientation for the reference instrument.

In the preferred embodiment the reference probe section (34) is equipped with a reference orientation calibration indicator consisting of a gyroscopic reference slot (60), which gyroscopic reference slot (60) provides a reference instrument calibration orientation. The purpose of the gyroscopic reference slot (60) is to assist in establishing the orientation relationship between the reference probe section (34) and the magnetic probe section (38).

The reference probe section (34) is configured so that the orientation reference indicator will provide an indication of a known or ascertainable calibration direction as the reference instrument calibration orientation when the tool (20) is positioned in the borehole (22). The calibration direction may be any direction.

For example, if the gyroscopic instrument (56) is a conventional gyroscopic instrument the calibration direction may be a direction ascertained by external measurement made prior to or following use of the tool (20). If the gyroscopic instrument (56) is a north seeking gyroscopic instrument the calibration direction may be true North or some other direction as determined for example with reference to the earth's inertial angular velocity vector. In the preferred embodiment the calibration direction for the reference probe section (34) is true North, which means that the gyroscopic instrument (56) will indicate true North when the gyroscopic reference slot (60) is pointing at true North.

The crossover section (36) provides a means for linking the reference probe section (34) and the magnetic probe section (38) such that a constant alignment and a convenient longitudinal spacing can be maintained between them. In the preferred embodiment the crossover section (36) is threadably connected between the reference probe section (34) and the magnetic probe section (38) and maintains alignment between them with the use of set screws or bolts and locking nuts.

Any apparatus which is capable of connecting the reference probe section (34) and the magnetic probe section (38) while maintaining the alignment between them may be used as the crossover section (36). Furthermore, the crossover section (36) may be eliminated if the reference probe section (34) and the magnetic probe section (38) are integrally constructed as a single component of the tool (20). There may also be components of the tool (20) in addition to the crossover section (36) which are interspersed between the reference probe section (34) and the magnetic probe section (38).

The magnetic probe section (38) is used to provide a magnetic directional measurement which is influenced by magnetic flux. As a result, the magnetic probe section (38) includes at least one magnetic instrument which is capable of providing the magnetic directional measurement.

In the preferred embodiment the magnetic probe section (38) is comprised of a magnetic instrument (62) contained within a magnetic probe housing (64). In the preferred embodiment the magnetic probe housing (64) is constructed of a non-magnetic material.

Any type of magnetic instrument (62) capable of making a magnetic directional measurement may be utilized in the magnetic probe section (38). For example, the magnetic instrument (62) may be comprised of a magnetic compass and may be incorporated into a single shot or multi-shot magnetic survey tool. In the preferred embodiment the magnetic instrument (62) is comprised of a magnetic survey system of the type which includes a magnetometer for making the magnetic measurement, such as for example the Electronic Survey Service ("ESS™") system manufactured by Sperry-Sun Drilling Services.

The ESS™ survey system includes a triaxial magnetometer and a triaxial accelerometer. The horizontal component of the earth's magnetic field vector is determined by correlation of the output of the magnetometer with the output of the accelerometer, thus enabling the system to be aligned to magnetic North (subject to the effects of sources of magnetic interference).

The function of the magnetic probe section (38) is to provide a magnetic directional measurement which is influenced by magnetic flux and to provide a mechanism to assist in establishing an orientation relationship between the reference probe section (34) and the magnetic probe section (38). As a result, the magnetic probe section (38) is equipped with an orientation calibration indicator for providing a calibration orientation for the magnetic measurement instrument.

In the preferred embodiment the magnetic probe section (38) is equipped with a magnetic orientation calibration indicator consisting of a magnetic T-slot (66), which magnetic T-slot (66) provides a magnetic instrument calibration orientation. The purpose of the magnetic T-slot (66) is to assist in establishing the orientation relationship between the reference probe section (34) and the magnetic probe section (38).

The magnetic probe section (38) is configured so that the orientation reference indicator will provide an indication of a known or ascertainable calibration direction as the magnetic instrument calibration orientation when the tool (20) is positioned in the borehole (22). The calibration direction may be any direction. In the preferred embodiment the calibration direction for the magnetic probe section (34) is magnetic North, which means that the magnetic instrument (62) will indicate magnetic North when the magnetic T-slot (66) is pointing at magnetic North (subject to the effects of magnetic interference).

The lower centralizer section (40) assists in centralizing the tool (20) in the borehole (22). In the preferred embodiment the lower centralizer section (40) includes a plurality of lower bow springs (68) as centralizing devices which engage the borehole (22) as the tool (20) passes through the borehole (22). Any other type of centralizing device may be used in the lower centralizer section (40), or the lower centralizer section (40) may be eliminated altogether.

The bull nose section (42) provides a leading surface at the lower end (26) of the tool (20) for assisting the tool (20) in moving through the borehole (22) and also protects the other components of the tool (20) from obstructions and debris which are encountered in the borehole (22). In the preferred embodiment the bull nose section (42) is threadably connected to the magnetic probe section (38). Alternatively, the bull nose section (42) may be formed integrally with the magnetic probe section (38) or may be connected to the magnetic probe section (38) other than with a threaded connection.

In preparing the tool (20) for use in a borehole (22) the various sections are connected together and the gyroscopic reference slot (60) is aligned with the magnetic T-slot (66) to provide an indicator differential representing the amount by which the slots (60,66) are separated circumferentially from each other. The indicator differential may be any value but in the preferred embodiment the tool (20) is assembled so that the indicator differential is equal to zero, thus simplifying the calculation of values of magnetic declination.

The tool (20) may be equipped with a data transmission system for transmitting data from the directional measurements from the tool (20) to the ground surface along the wireline (44) or in some other manner such as with a measurement while drilling ("MWD") system or with a telemetry system. Alternatively, the tool (20) may be equipped with a data storage device for storing such data until the tool (20) is retrieved from the borehole (22). In the preferred embodiment the tool (20) is equipped with a data transmission system which transmits data to the surface from the casing collar locator section (32), the reference probe section (34) and the magnetic probe section (38).

The above description of the preferred embodiment of the tool (20) is exemplary and as previously indicated, the order of the various sections comprising the tool (20) may be altered and some sections may be modified or eliminated altogether. Additional components may also be added to the tool (20). The only essential components of the tool (20) are the reference measurement instrument and the magnetic measurement instrument, which may be provided in separate sections of the tool (20) or may be integrated into a single instrument section.

The method of the invention may be performed using the tool (20) of the preferred embodiment of the apparatus form of the invention or may be performed using some other apparatus or collection of apparatus.

Generally, the performance of the method of the invention requires only that a magnetic directional measurement be made at a longitudinal location in the borehole (22) and at a magnetic measurement orientation and that a non-magnetic reference directional measurement be made at a reference measurement orientation which has a known or ascertainable orientation relationship with the magnetic measurement orientation. The absolute orientation at which either or both of the magnetic directional measurement or the reference directional measurement is made does not matter as long as the orientation relationship is ascertainable.

One advantage to the tool (20) of the preferred embodiment is that it is capable of maintaining a constant indicator differential between the gyroscopic reference slot (60) and the magnetic T-slot (66). In the performance of the method of the invention, this feature results in a constant relationship between the orientation at which magnetic measurements are taken and the orientation at which reference measurements are taken. In other words, the tool (20) establishes and maintains the orientation relationship.

In the performance of a preferred method form of the invention using the tool (20), the sections of the tool (20) are first assembled so that the gyroscopic reference slot (60) is aligned with the magnetic T-slot (66), preferably so that the indicator differential is equal to zero.

Referring to FIG. 2, the tool (20) is then lowered into the borehole (22) to position the magnetic instrument (62) at a desired longitudinal location in the borehole (22). The desired longitudinal location may be achieved in any manner. For example, the desired longitudinal location may be established with reference to the amount of wireline (44) which has been paid out in lowering the tool (20) in the borehole (22), by moving the tool (20) through the borehole (22) relative to a benchmark station of known depth, by moving the tool (20) through the borehole (22) past a desired number of casing collars as indicated by the casing collar locator section (32), or by a combination of methods.

A magnetic directional measurement and a non-magnetic directional measurement are then made with the magnetic instrument positioned at the longitudinal location.

Finally, a value of magnetic declination at the longitudinal location is obtained using the magnetic directional measurement, the non-magnetic directional measurement and the indicator differential.

The method may be repeated by moving the tool (20) through the borehole (22) to a number of longitudinal locations and making magnetic and non-magnetic measurements at those longitudinal locations in order to obtain a magnetic declination profile for the borehole.

Two examples illustrating the use of the method and apparatus of the invention follow.

EXAMPLE 1

One exemplary application for the method is in establishing a magnetic declination profile for a cased borehole (22) in which a whipstock (not shown) or some other form of diverting tool must be set for directional drilling or for reentry into a branch borehole (not shown).

In this application, the tool (20) may be run into the borehole (22) on the wireline (44) after a bridge plug (not shown) has been set in the borehole (22) at a kick-off-point (not shown). The kick-off-point establishes the lower depth limit for the magnetic declination profile.

A magnetic declination profile is then created by making a series of magnetic measurements and related reference measurements at a range of depths above the kick-off-point, following which the tool (20) is removed from the borehole (22).

The whipstock is then lowered into the borehole (22) on a pipe string (not shown) which includes a measurement-while-drilling ("MWD") system (not shown). The MWD system includes a magnetic instrument (not shown) which is aligned in a known orientation with the whipstock face (not shown). The whipstock is then oriented in the borehole (22) at the kick-off-point using magnetic directional data which is generated by the MWD system and is corrected using the magnetic declination profile for the borehole (22). The whipstock is set in the borehole (22) and if necessary a window (not shown) may be milled in the casing (52) at the kick-off-point using a milling tool (not shown).

Once the whipstock has been oriented and set in the borehole (22) and any necessary window has been milled in the casing string (52) at the kick-off-point, a drilling string (not shown) including a downhole motor (not shown) and the MWD system may be run into the borehole (22). The MWD system is connected with the motor at a known orientation relative to a high side indicator (not shown) on the motor. The motor is positioned at the kick-off-point with its high side indicator directed at the window using magnetic directional data which is generated by the MWD system and is corrected using the magnetic declination profile for the borehole (22).

Drilling is then commenced, guided by magnetic directional data from the MWD system which is corrected using the magnetic declination profile, until sufficient inclination angle is built or sufficient distance from the cased borehole (22) is achieved to enable drilling to be continued using a steering tool (not shown) or a magnetic survey tool (not shown).

EXAMPLE 2

A second exemplary application for the method is in determining the orientation of an orienting lug (not shown) in a packer (not shown) which has previously been set in the borehole (22) at the kick-off-point while simultaneously generating data in order to create a magnetic declination profile for the borehole (22) above the kick-off-point.

In this application, the lower end (26) of the tool (20) is provided with a mule shoe stinger (not shown) which is aligned with both the gyroscopic reference slot (60) and the magnetic T-slot (66). The mule shoe stinger is configured to engage the orienting lug on the packer when the tool (20) is run into the borehole (22). The mule shoe stinger is magnetically isolated from the magnetic probe section (38) of the tool (20) using a sufficient length of aluminum (not shown) or other non-magnetic material between the magnetic probe section (38) and the mule shoe stinger.

The tool (20) is run into the borehole (22) until the mule shoe stinger engages the orienting lug. A magnetic directional measurement and a reference directional measurement are made while the mule shoe stinger is engaged with the orienting lug. The magnetic declination survey may be conducted either as the tool (20) is run into the borehole (22) or as the tool (20) is retrieved from the borehole (22).

The tool (20) is then removed from the borehole (22). A whipstock or other diverting tool may then be lowered into the borehole (22) in a similar manner as in Example 1, with the mule shoe on the whipstock offset from the whipstock face so as to achieve a desired orientation relative to the orienting lug on the packer when the whipstock is set in the packer. If necessary, a window may be milled in the casing string (52) at the kick-off-point.

A drilling string may then be lowered into the borehole (22) in a similar manner as in Example 1 and drilling may proceed as in Example 1.

As indicated, these examples are merely exemplary of the many potential applications for the invention. In addition, variations of the two examples described above may be utilized.

For example, the steps of orienting the whipstock in the borehole (22) and drilling from the kick-off-point may be performed using a conventional jointed pipe string or using a coiled tubing system (not shown).

In Example 1, the whipstock face may be suitably oriented at the kick-off-point using a coiled tubing system in which a coiled tubing orienter (not shown) is aligned in known orientation relative to both the magnetic instrument in the MWD system and the whipstock face. In Example 2, a coiled tubing system may be used both for lowering the whipstock into the borehole (22) and for drilling thereafter. A coiled tubing system may also be utilized instead of the wireline (44) or a pipe string in order to lower the tool (20) into the borehole (22).

The embodiments of the invention in which an exclusive property or privilege is claimed are defined as follows:

1. A method for creating a magnetic declination profile for a borehole comprising the steps of:

(a) making a first magnetic directional measurement at a first longitudinal location in the borehole, wherein the first magnetic directional measurement is influenced by magnetic flux and wherein the first magnetic directional measurement is made at a first magnetic measurement orientation;

(b) making a first reference directional measurement in the borehole, wherein the first reference directional measurement is not influenced by magnetic flux, wherein the first reference directional measurement is made at a first reference measurement orientation, wherein there is a first orientation relationship between the first magnetic measurement orientation and the first reference measurement orientation and wherein the first orientation relationship is known or ascertainable; and (c) obtaining a value of magnetic declination at the first longitudinal location in the borehole using the first magnetic directional measurement, the first reference directional measurement and the first orientation relationship.

2. The method as claimed in claim 1 wherein the first magnetic directional measurement is made with a magnetic instrument.

3. The method as claimed in claim 2 wherein the first reference directional measurement is made with a gyroscopic instrument.

4. The method as claimed in claim 3 wherein the step of obtaining the value of magnetic declination at the first longitudinal location in the borehole is comprised of the following steps:

(a) calculating a first measurement differential between the first magnetic directional measurement and the first reference directional measurement;

(b) calculating a first orientation differential between the first magnetic measurement orientation and the first reference measurement orientation; and (c) adjusting the first measurement differential by the amount of the first orientation differential to obtain the value of magnetic declination at the first longitudinal location in the borehole.

5. The method as claimed in claim 4 wherein the magnetic instrument and the gyroscopic instrument are linked to provide the first orientation relationship.

6. The method as claimed in claim 5 wherein the first orientation differential is equal to zero so that the first measurement differential is equal to the value of magnetic declination at the first longitudinal location in the borehole.

7. The method as claimed in claim 5 wherein the borehole has an inclination relative to vertical at the first longitudinal location and wherein the inclination of the borehole at the first longitudinal location is less than about five degrees.

8. The method as claimed in claim 7 wherein the borehole is lined with a metallic casing at the first longitudinal location.

9. The method as claimed in claim 5 wherein the method is performed at a plurality of longitudinal locations in the borehole to create a magnetic declination profile for the borehole at the plurality of longitudinal locations using the values obtained for magnetic declination at the plurality of longitudinal locations.

10. A method for conducting a magnetic declination survey for a borehole, the method comprising the following steps:

(a) connecting a magnetic instrument with a gyroscopic instrument to provide a magnetic declination logging tool;

(b) aligning a magnetic orientation calibration indicator associated with the magnetic instrument with a reference orientation calibration indicator associated with the gyroscopic instrument to provide a known first indicator differential between the magnetic orientation calibration indicator and the reference orientation calibration indicator;

(c) lowering the magnetic declination logging tool into the borehole to position the magnetic instrument at a first longitudinal location;

(d) making a first magnetic directional measurement with the magnetic instrument at the first longitudinal location;

(e) making a first reference directional measurement with the gyroscopic instrument; and (f) obtaining a value of magnetic declination at the first longitudinal location in the borehole using the first magnetic directional measurement, the first reference directional measurement and the first indicator differential.

11. The method as claimed in claim 10 wherein the magnetic orientation calibration indicator provides a magnetic instrument calibration orientation which is known with respect to magnetic North, wherein the reference orientation calibration indicator provides a reference instrument calibration orientation which is known with respect to true North and wherein the first indicator differential provides a first orientation differential.

12. The method as claimed in claim 11 wherein the step of obtaining the value of magnetic declination at the first longitudinal location in the borehole is comprised of the following steps:

(a) calculating a first measurement differential between the first magnetic directional measurement and the first reference directional measurement; and (b) adjusting the first measurement differential by the amount of the first orientation differential to obtain the value of magnetic declination at the first longitudinal location in the borehole.

13. The method as claimed in claim 12 wherein the magnetic instrument calibration orientation indicates magnetic North and wherein the reference instrument calibration orientation indicates true North.

14. The method as claimed in claim 13 wherein the first indicator differential is equal to zero so that the first measurement differential is equal to the value of magnetic declination at the first longitudinal location in the borehole.

15. The method as claimed in claim 14 wherein the borehole has an inclination relative to vertical at the first longitudinal location and wherein the inclination of the borehole at the first longitudinal location is less than about five degrees.

16. The method as claimed in claim 15 wherein the borehole is lined with a metallic casing at the first longitudinal location.

17. The method as claimed in claim 11 wherein the method is performed at a plurality of longitudinal locations in the borehole to create a magnetic declination profile for the borehole at the plurality of longitudinal locations using the values obtained for magnetic declination at the plurality of longitudinal locations.

* * * * *